United States Patent [19]

Meyers

[11] 4,203,355

[45] May 20, 1980

[54] PACKAGING STRUCTURE AND APPARATUS USEFUL IN ITS ASSEMBLY

[75] Inventor: George L. Meyers, Menasha, Wis.

[73] Assignee: American Can Company, Greenwich, Conn.

[21] Appl. No.: 884,193

[22] Filed: Mar. 7, 1978

[51] Int. Cl.[2] ..... B31B 1/22

[52] U.S. Cl. ..... 93/58 R; 53/372; 53/376

[58] Field of Search ..... 53/372, 374, 376, 167; 93/36 A, 58 R

[56] References Cited

U.S. PATENT DOCUMENTS

| | | | |
|---|---|---|---|
| 2,913,863 | 11/1959 | Sylvester et al. | 53/372 X |
| 3,106,876 | 10/1963 | Dewhurst | 93/37 R |
| 3,283,991 | 11/1966 | Hughes | 229/51 |
| 3,307,329 | 3/1967 | Lefief | 53/376 |
| 3,355,857 | 12/1967 | Tobey | 53/372 X |
| 3,443,353 | 5/1969 | DiVecchio | 53/376 X |
| 3,533,214 | 10/1970 | Standley | 53/167 |
| 3,534,666 | 10/1970 | Maccherone | 93/35 R |
| 3;559,368 | 2/1971 | Standley et al. | 53/167 |
| 3,597,900 | 8/1971 | Scott | 53/376 X |
| 3,733,772 | 5/1973 | Dichiara | 53/167 |
| 3,741,081 | 6/1973 | Lutz | 93/36 A X |

*Primary Examiner*—James F. Coan

*Attorney, Agent, or Firm*—Robert P. Auber; Ira S. Dorman; Harry W. Hargis

[57] ABSTRACT

An end construction for a sealed carton comprises a first weakness line disposed between the closure panel end flap and an extension thereof. The first weakness line is severable by a wire over which the panel and its extension are sealed to a carton end, by gluing, in a form, fill, and seal apparatus. Severance of the first weakness line by the wire is effected as the sealed carton is moved through the apparatus. A second weakness line is provided in the closure end flap and extends with angularity to the first weakness line to intersect same. A resulting triangular section of the closure end flap is glued, as is the severed flap extension to the end of the carton, and retains the closure in closed position until such time the second weakness line is torn upon moving the closure to open position. The severed flap extension remains glued to the end of the carton to reinforce same and maintain its assembly.

7 Claims, 9 Drawing Figures

FIG. 4
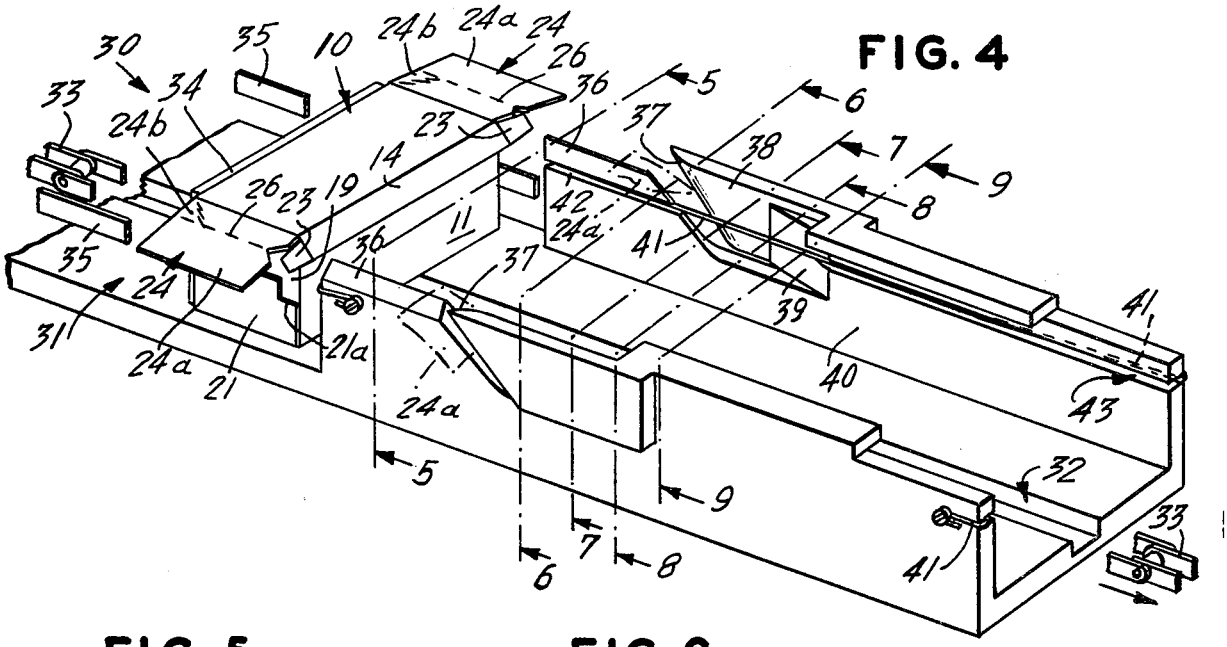
FIG. 5
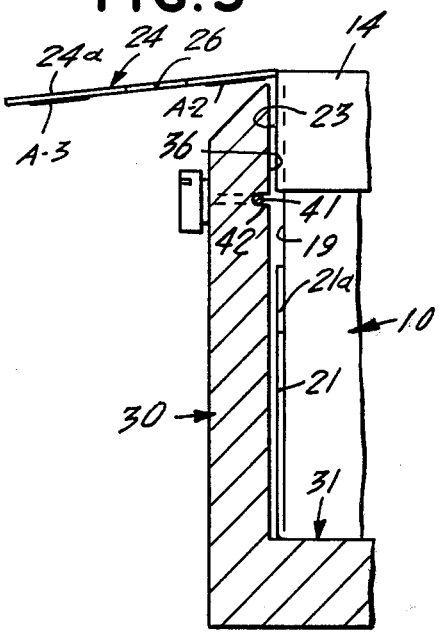
FIG. 6
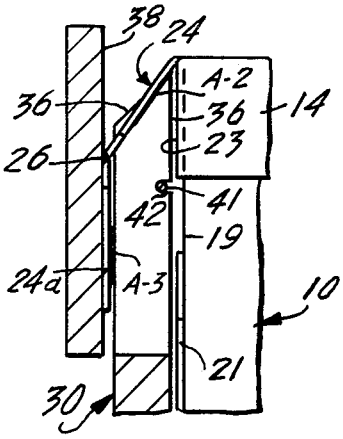
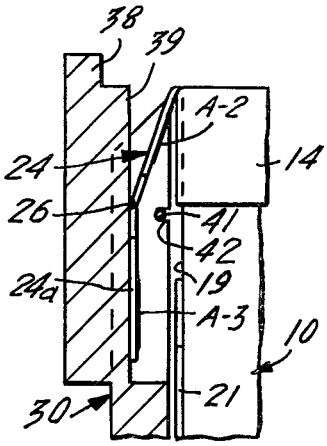
FIG. 7
FIG. 8
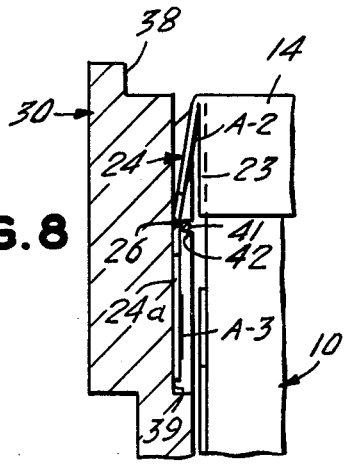
FIG. 9
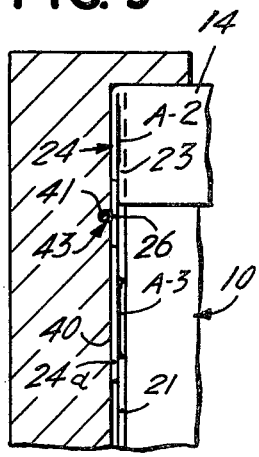

PACKAGING STRUCTURE AND APPARATUS USEFUL IN ITS ASSEMBLY

BACKGROUND OF THE INVENTION

The present invention is directed to improvements in packaging structure and apparatus useful in its assembly. While of broader applicability, the invention is particularly useful in the assembly of top-opening cartons of the so-called flip-top type.

In the assembly of packaging structure, such as top-opening cartons, it has been found difficult to form side or end flaps thereof economically while providing a carton that is easily opened along a line of weakness. In top-opening cartons of the flip-top type, a closure or cover is provided in the form of a panel hinged to the carton body along a fold line. The remaining three sides of the closure have flaps that overlap adjacent carton wall panels, and at least the opposed flaps are sealed thereto by flap extensions provided with lines of weakness. Contents of the carton are accessible by lifting the closure about its hinged connection while tearing the flap extensions along corresponding lines of weakness. The lines of weakness, of course, must be readily tearable in order that the carton not be so damaged as to prevent its reclosure.

It is a general objective of this invention to provide improved carton structure of the aforementioned type, and apparatus facilitating its assembly.

SUMMARY OF THE INVENTION

In achievement of the foregoing as well as other objectives, the invention contemplates carton structure, preferably of generally rectangular configuration, provided with a top closure panel hinged along one edge thereof and a tearable flap on at least opposed ones of the other edge portions sealed to the carton body. Means affording tearing of flaps on the opposed ones of the edge portions are partially cut or torn in the assembly thereof to facilitate opening of the carton. The invention further contemplates apparatus useful in the assembly of such a carton and comprising means for moving a partially assembled carton along a travel path, said carton having open end flaps extending in a direction transverse to the travel path, cutting edge means disposed adjacent the travel path, and means for folding the end flaps and sealing end portions thereof, as the carton is moved along the travel path, the cutting edge means thereupon being effective to sever the flaps from their sealed portions.

The manner in which the foregoing as well as other objectives and advantages of the invention may best be achieved will be more fully understood from a consideration of the following description, taken in light of the accompanying drawings.

BRIEF DESCRIPTION OF THE DRAWINGS

FIG. 4 is a fragmentary perspective view illustrating the partially assembled cartion of FIG. 1 in combination with apparatus useful in assembling same; and FIGS. 5 to 9 are sectional views, taken in the direction of arrows 5—5 to 9—9, respectively, applied to FIG. 4, and illustrating steps in the assembly of the carton seen in FIGS. 2 and 3.

DETAILED DESCRIPTION OF THE INVENTION

Figure 1:
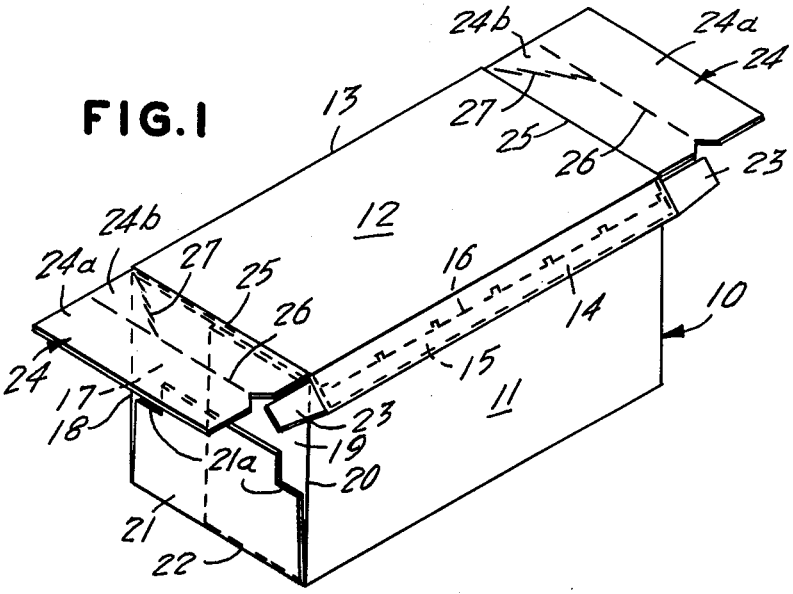
FIG. 1 is a perspective view of a partially assembled carton embodying the invention.

With more detailed reference to FIG. 1, a filled, generally rectangular carton 10 of the flip-top type, and fabricated of a resilient material such as, for example, paperboard, is shown in partially assembled mode and comprises a front wall panel 11, a corresponding rear wall panel (not shown), a bottom wall panel (not shown), and a top wall panel 12 serving as a carton closure and hinged along a fold line 13 on one edge thereof to the rear wall panel. Top wall panel 12 includes side flap 14 on a free edge disposed opposite fold line 13. Flap 14 is glued, or otherwise conveniently adhered, to a downturned flap 15 provided on an upper edge of front wall panel 11 and including a weakness line 16. With reference still to FIG. 1, each vertical edge of the rear wall panel of carton 10 includes a fold line 18 about which end flap 17 is folded to extend over part of the corresponding carton end, and each vertical edge of the front wall panel 11 of the carton includes an end flap 19 folded about a fold line 20 to extend over flap 17. An end flap 21 on a horizontal edge of the bottom wall panel is folded upwardly about a fold line 22 onto the overlapping flaps 17, 19, which end flap 21 includes notched corners **21*a*. It will be appreciated, therefore, that the structure of the non-visible, far end of carton 10** is identical with the visible, near end.

Figure 2:
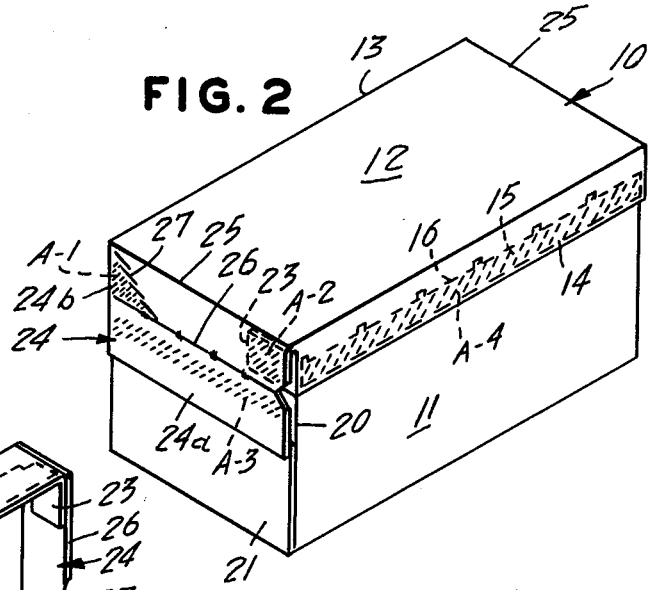
FIG. 2 is a perspective view of a fully assembled carton embodying the invention.

In especial accordance with the invention, flap 14 of top wall panel 12 includes a pair of end tabs 23 foldable about vertically extending fold lines, at right angles onto end flaps 19; and a pair of end flaps 24 on panel 12 are foldable along horizontally extending fold lines 25 onto ends of the carton, to positions seen in FIG. 2. Each end flap 24 includes an extension **24*a* provided with a horizontally extending first line of weakness 26. Each flap 24 includes a second line of weakness 27 intersecting the upper end of fold line 18 and extending with angularity to intersect horizontally extending line of weakness 26, thus defining, with a rear vertical edge of the flap and a portion of line 26, a triangular section 24*b***.

In achievement of carton sealing, glue, or other suitable adhesive, is applied in patterns as shown by stippling designated generally by reference characters A-1, A-2, A-3, and A-4 applied to FIG. 2, alone, for convenience of illustration. Of the glue patterns, A-1 adheres triangular section **24*b* to flap 17, A-2 adheres flap 24 to flap 23, A-3 adheres flap extension 24*a* to the underlying free edge region of flap 21 and portions of flaps 17, 19 in registry with notched, or otherwise relieved, portions 21*a* of flap 21**.

Figure 3:
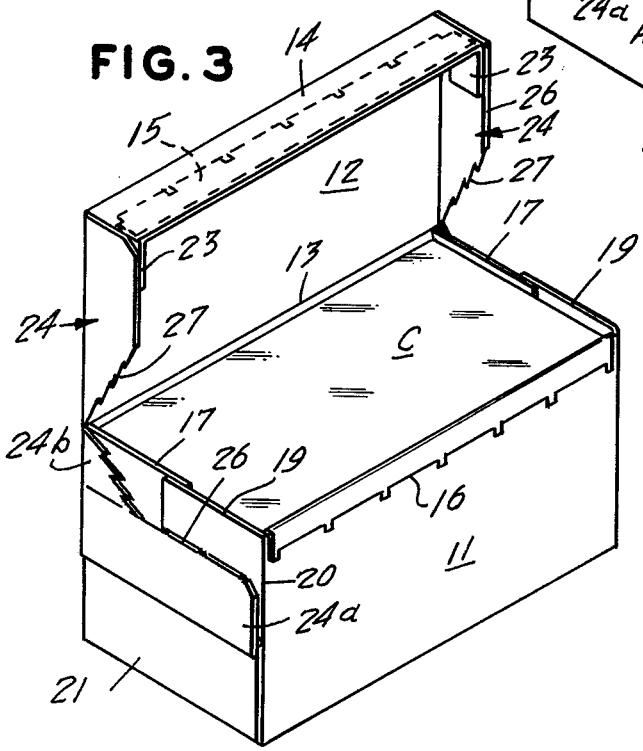
FIG. 3 is a view of the assembled carton seen in FIG. 2, in opened position.

Further to the invention, line of weakness 26 will have been severed in the showing of FIG. 2, by means contemplated by the invention, and to be described in connection with FIGS. 4 to 9. To open carton 10, and with reference also to FIG. 3, flaps 14, 15 are urged upwardly and outwardly to tear flap 15 along line of weakness 16, and flaps 24 along lines of weakness 27 while top wall panel 12 is pivoted about fold line 13, to the illustrated open position exposing contents C. Advantageously, assembly of the opened carton is maintained through sealing by glue strip A-3, of the extension **24*a* on each flap 24 to the underlying free edge region of flap 21 and to the portions of flaps 17, 19 in registry with the notched portions 21***a* of flap 21.

Turning now to apparatus contemplated by the invention for assembling carton 10 thus far described, reference is made to FIGS. 4 to 9 of the drawings. As is seen to advantage in FIG. 4, apparatus for assembling carton 10 includes the conveyor section 30 of a form, fill, and seal machine of otherwise conventional design. Conveyor section 30 includes a horiztonally extending, elongate track section 31 provided with a central longitudinal groove 32 within which rides a conveyor chain 33 driven by known means. Chain 33 includes vertically extending pusher elements, only one of which is shown at 34, placed at intervals along the chain. Each pusher element 34 is disposed and adapted abuttingly to engage the rear side wall panel (not shown) of a carton 10.

The stage of assembly of carton 10 as shown in FIG. 4 corresponds to the showing of FIG. 1 in which the carton has been filled and is ready to be closed and sealed. It is also to be understood that glue has been applied to flap 24 by suitably positioned glue applicators of known type, in the patterns hereinabove described. With further reference to FIG. 4, a pair of opposed side rails 35 of conveyor section 30 engage upwardly folded end flaps 21 of the carton to guide it along the track as it is pushed by elements 34 from left to right. Downstream of side rails 35 are a series of oppositely paired flap plows 36, 37, 38, 39, and 40 disposed and adapted sequentially to engage and fold the flaps 23 and 24 in accordance with the sectional showings in FIGS. 5, 6, 7, 8, and 9.

Engagement of a flap 23 by a suitably presented plow 36 is illustrated to advantage in FIG. 5, in which Figure flaps 23 have been folded inwardly and are held against the folded end flaps 19 of the filled carton. As carton 10 continues to be moved along the conveyor, another pair of flap plows 37, 38, sequentially engage the flaps 24 in accordance with the broken line showing of FIG. 4 and the showing of FIG. 6. Further transfer of carton 10 along conveyor section 30 is illustrated in FIG. 7, where plow 39 further has urged flaps 24 toward the end flaps 19 and 23 of the carton.

Continued movement of carton 10 is illustrated in FIG. 8, where, in especial accordance with the invention, flaps 24 have just been urged against means defining a pair of elongate cutting edges each comprising a wire 41, such as, for example, a single strand of tautly supported steel wire of relatively small diameter, disposed in laterally inwardly facing grooves 42, 43 provided within plows 36 and 40, respectively. Positioning of each wire 41 is such that an upstream portion thereof, as respects direction of conveyor travel, is disposed in substantially adjacent, overlying relationship as respects the end of the carton, and its downstream portion is positioned a short space, laterally outwardly, from the carton. This lateral spacing is characterized in that the wire 41 in a portion of groove 43 is disposed with angularity as respects the travel of the carton. By such angularity, and with reference to FIG. 9, each flap 24 with its line of weakness 26 coinciding with the line of extension of the cutting wire 41 is urged by plow 40 against the wire to the extent that the wire cuts through the aforesaid line of weakness. Urging of flaps 24 by plows 40 further causes the regions of applied adhesive A-1, A-2, A-3, and A-4 to engage and adhere their corresponding underlying end flap regions as described in connection with FIG. 2.

It will be appreciated that severing the horizontal line of weakness 26 further is aided by provision of a V-shaped notch 24*c* on flap 24 presented in the direction of conveyor travel and having its vertex at the downstream end of line 26. By such disposition, notch 24*c* is capable of compensating for slight misalignments of wire 41 with line 26, since the wire, by virtue of its inherent flexibility, may be channeled by sides of the notch into alignment with line 26.

Provision of a line of weakness 26 capable of being severed on the conveyor to leave a reinforcing, carton sealing flap portion 24*a* advantageously enhances both retention of carton assembly and ease of opening due to partial tearing of the adherent closure flap. Only line of weakness 27 then need be torn to release the closure wall panel 12 from the closure-maintaining flap portion 24*b*. It is to be understood that the invention contemplates that carton closure may be maintained solely by adherence of flap portion 24*b* to flap 17, without need for adhering flap 14 in the manner disclosed.

While preferred embodiments of the invention have been illustrated and described, it will be appreciated that modifications may be made without departing from the scope of the appended claims.

I claim:

1. Apparatus for use in the assembly of a partially erected carton of the type having at least one flap having one end hingedly attached to said carton and an opposite free end, said flap being adapted for intimate contact with portions of one wall of said carton for closing and sealing the same, said apparatus comprising:

means for moving said carton along a travel path, with said flap extending in a direction transverse to the travel path;

means adjacent said travel path for folding said flap against the main body of said carton as it is moved along said travel path;

means for forcing said flap into intimate contact with said wall portions, for bonding thereto, after said flap is folded against said wall portions;

and means disposed adjacent said travel path for severing said flap along a line between said one end and said free end thereof after said flap is folded to the closing and sealing position.

2. Apparatus according to claim 1, and characterized in that said cutting means comprises structure defining a cutting edge extending along said travel path and including a section outwardly spaced from the latter.

3. Apparatus according to claim 1, and characterized in that said severing means comprises a wire supported to extend along said travel path and including a section spaced outwardly from said travel path and adapted for forcing said wire through said flap, whereby said flap may have a frangible line of weakness disposed for alignment with said severing means, and operative with said wire for severance of said flap.

4. Apparatus for closing and sealing a rectangular carton of the type having a main closure panel provided with at least one end flap adapted for closing and sealing a wall of the carton, and having a line of weakness extending from the front edge of the flap to the rear edge of the flap, the line of weakness defining a severable portion of the flap, comprising:

means for conveying a carton to be closed and sealed along a travel path;

means along said travel path for folding and sealing said flap portion to a position perpendicular to said main closure panel;

and means, disposed adjacent said travel path, over which said flap may be folded to said position as said carton is conveyed along said travel path, for severing said severable portion after said flap is so folded, said severing means and folding means being cooperatively disposed so that said folding means folds the flap over said severing means.

5. Apparatus as in claim 4, and including a pair of end flaps and flap portions on opposed ends of said carton, and including:

means along said travel path for folding and sealing said flap portions;

and means, disposed adjacent said travel path, over which said flaps may be folded to said positions, said severing means and folding means being cooperatively disposed so that said folding means folds the flaps over said severing means.

6. Apparatus for closing and sealing a rectangular carton of the type having a main closure panel provided with end flaps having severable carton sealing and closing portions, comprising:

means for conveying a carton to be sealed along a travel path;

means for folding said flap portions against end wall portions of said carton for closing the same;

means for forcing said flap portions into intimate contact with said end wall portions for bonding thereto, after said flaps are folded against said end wall portions; and severing means disposed adjacent said travel path for severing said severable portions after said flaps are folded to the closing and sealing position.

7. Apparatus according to claim 6, and characterized in that said cutting means comprises a relatively thin wire over which said flaps are folded.

* * * * *